United States Patent [19]

Gregoli et al.

[11] Patent Number: 4,818,370

[45] Date of Patent: Apr. 4, 1989

[54] PROCESS FOR CONVERTING HEAVY CRUDES, TARS, AND BITUMENS TO LIGHTER PRODUCTS IN THE PRESENCE OF BRINE AT SUPERCRITICAL CONDITIONS

[75] Inventors: A. A. Gregoli; Uriel M. Oko; Frederic Leder, all of Tulsa, Okla.

[73] Assignee: Cities Service Oil and Gas Corporation, Tulsa, Okla.

[21] Appl. No.: 96,000

[22] Filed: Sep. 14, 1987

Related U.S. Application Data

[63] Continuation-in-part of Ser. No. 888,412, Jul. 23, 1986, abandoned.

[51] Int. Cl.[4] ..... C10G 9/34

[52] U.S. Cl. ..... 208/106; 208/113; 208/125; 208/130; 208/284

[58] Field of Search ..... 208/106, 130, 112, 113, 208/284, 125

[56] References Cited

U.S. PATENT DOCUMENTS

| | | | |
|---|---|---|---|
| 3,265,612 | 8/1966 | Dulaney et al. | 208/125 |
| 3,668,109 | 6/1972 | Kiovsky et al. | 208/108 |
| 3,989,618 | 11/1976 | McCollum et al. | 208/106 |
| 4,326,581 | 4/1982 | Rapier | 165/45 |
| 4,363,717 | 12/1982 | Pelrine et al. | 208/108 |
| 4,370,223 | 1/1983 | Bose | 208/125 |
| 4,428,828 | 1/1984 | Bose | 208/130 |
| 4,446,012 | 5/1984 | Murthy et al. | 208/130 |
| 4,483,761 | 11/1984 | Paspek, Jr. | 208/106 |
| 4,543,177 | 9/1985 | Murthy et al. | 208/130 |
| 4,594,141 | 6/1986 | Paspek, Jr. et al. | 208/113 |

*Primary Examiner*—Anthony McFarlane
*Attorney, Agent, or Firm*—John Wade Carpenter

[57] ABSTRACT

A majority amount of a heavy hydrocarbon crude is reacted with a minor amount of brine, at supercritical temperature and pressure for the brine, for a predetermined period of time in order to upgrade and convert the heavy hydrocarbon crude into a lighter hydrocarbon crude of higher API gravity. The upgrading and conversion of a viscous heavy hydrocarbonaceous crude oil into lighter hydrocarbons is accomplished in a continuous reactor system and may be accomplished in a subterranean petroleum reservoir at supercritical temperature and pressure. The overall heat of reaction is neutral, i.e., neither exothermic nor endothermic. In order to provide the necessary temperature, heat is added to the system prior to the reaction. For an in situ application, a combustion operation may be utilized to provide the necessary temperature, and is initiated using an oxidizing gas injected through an injection well. After a predetermined amount of time, injection of the oxidizing gas is terminated and the injection well is shut-in for a predetermined period of time to permit the petroleum reservoir to undergo a soak period in order to increase the temperature and decrease the viscosity of the viscous heavy hydrocarbonaceous crude oil. As the viscosity of the heavy hydrocarbonaceous crude oil decreases, the oil flows downwardly into the combustion zone steam and/or brine is injected which is at supercritical conditions in order to upgrade the heavy hydrocarbonaceous crude oil into lighter fractions. The reaction products from a reactor or an in situ operation are also lower in obnoxious constituents such as sulfur, nitrogen and heavy metals.

9 Claims, 3 Drawing Sheets

PROCESS FOR CONVERTING HEAVY CRUDES, TARS, AND BITUMENS TO LIGHTER PRODUCTS IN THE PRESENCE OF BRINE AT SUPERCRITICAL CONDITIONS

BACKGROUND OF THE INVENTION

This is a continuation-in-part application of our copending application having Ser. No. 888,412, filed July 23, 1986, now abandoned.

1. Field of the Invention

This invention is related to the conversion of heavy hydrocarbon crudes, tars and bitumens. More specifically, this invention provides a process for converting a heavy hydrocarbon crude having a high viscosity into a lighter hydrocarbon crude of higher API gravity. The conversion may take place in a reactor or in a subterranean petroleum reservoir.

2. Description of the Prior Art

The problems of refiners in processing heavy crude (e.g., approximately 5° to about 18° API) result in discounts below the posted light crude price. The investment and operating costs associated with upgrading the lower value heavy crudes into higher value lighter crudes vary significantly. Current refinery capacity to convert heavy crude fractions exists, but it will become limited as worldwide heavy crude production increases. Present day refinery technology for converting heavy crudes, bitumens, etc., to lighter products utilizes costly: (1) hydrocracking or (2) combinations of coking or thermal operations followed by some form of hydroprocessing. Both schemes are capital intensive and require a sophisticated refinery infrastructure including hydrogen plants, fuel, and feed for the production of hydrogen or a source of hydrogen. Our concept can produce products with essentially the same products at lower investment and operating costs eliminating much of the refinery investment. This will, in the long term, place greater restrictions on the producer to market significant quantities of heavy crudes.

West German Offenlegungsschrift 25 22 313 discloses extracting hydrocarbons from carbonaceous materials using solvents containing water at high temperature and pressure. U.S. Pat. No. 3,051,644 to Friedman, et al., teaches a process for recovery of oil from oil shale by admixing oil shale particles with steam at high temperatures and pressures. U.S. Pat. No. 2,434,815 by Shaw presents a method and apparatus for educting oil from oil shale in a retort by use of superheated stream. U.S. Pat. No. 3,850,738 by Stewart, et al., teaches a bituminous coal liquefaction process wherein comminuted coal as an aqueous slurry is contacted with supercritical water at temperatures and pressures to provide thermal cracking of alkane bonds in the presence of hydrogen. U.S. Pat. No. 3,948,754 to McCollum, et al., teaches a process for recovering and upgrading hydrocarbons from oil shale and tar sands by contacting the oil shale or tar sands with a dense-water-containing fluid at a temperature in the range of from about 600° F. to about 900° F. in the absence of supplied hydrogen and in the presence of a sulfur and nitrogen-resistant catalyst and wherein the density of the water in the fluid is at least 0.10 gram per milliliter. U.S. Pat. No. 3,948,755 also to McCollum, et al., teaches a process for recovering and upgrading hydrocarbons from oil shale and tar sands by contacting the oil shale or tar sands with a dense-water-containing fluid at a temperature in the range of from about 600° F. to about 900° F. in the absence of externally supplied hydrogen and in the presence of a sulfur-resistant catalyst and wherein the density of the water in the fluid is at least 0.10 gram per milliliter. U.S. Pat. No. 3,960,702 by Alfred presents the retorting of oil shale using vapor phase water at about 850°–950° F., at a superficial gas velocity of about 20 feet per minute and at a pressure in the range of from about 1 to about 150 psia. McCollum, et al., in U.S. Pat. No. 3,983,027 discloses a process for recovering and upgrading products from solid coal by contacting the coil with a dense-water-containing fluid at a temperature in the range of from about 600° F. to about 900° F. in the absence of an externally supplied catalyst and hydrogen or other reducing gas. The density of water in the water-containing fluid is at least 0.10 grams per milliliter, and sufficient water is present to serve as an effective solvent for the recovered liquids and gases. In U.S. Pat. No. 3,988,238, McCollum, et al., recovers and upgrades products from solid coal in the presence of a sulfur-resistant catalyst while contacting the coal with the dense-water-containing fluid. U.S. Pat. No. 3,994,343, by Cha, et al., provides the sequential steps of passing air through a static bed of oil shale with a combustion zone for a sufficient time to produce a hot zone of predetermined thickness trailing the combustion zone, and thereafter passing a substantially oxygen free retorting off gas through the bed in the same direction the air has passed for a sufficient time to reduce the maximum temperature of the bed to a predetermined temperature greater than the self-ignition temperature of the shale.

Thus, it is known to recover oil from oil shale by admixing oil shale particles with steam at high temperatures and pressures. Eduction of oil from oil shale by use of superheated steam may be accomplished in a retort. It is also known to recover and upgrade hydrocarbons from oil shale and tar sands by contacting the oil shale or tar sands with a dense-water-containing fluid at a temperature in the range of from 600° F. to 900° F.

It is further known to recover hydrocarbons from a hydrocarbon bearing subterranean formation, in particular, a heavy oil reservoir or tar sand, by penetrating the formation with a production well and an injection well (which may be vertical or horizontal), igniting the hydrocarbons in the deposit, injecting air to cause burning of a portion of the hydrocarbons in situ, and recovering hydrocarbons which are reduced in viscosity by the heat generated by the burning. Processes involving forward combustion wherein an oxygen-containing gas is injected into an injection well causing forward burning in the direction of a production well are known. Also further known are reverse combustion processes wherein combustion is initiated in a production well with oxygen-containing gas injection from an injection well and movement of the firefront from the production to the injection well and production of hydrocarbon from the production well. Enhancement of the effectiveness of such fireflood processes by introduction of water into proximity with the burning zone is also known.

Such combustion processes are particularly advantageous where the production well is the center well of a five-spot or nine-spot configuration when a forward combustion process is employed. Line drive configurations are also advantageously employed, especially for horizontal injection wells.

Advantageous and valuable though such processes are, certain problems are evident. Sweep efficiency of the front is often less than desirable because pressure and temperature are not high enough in the condensing steam zone preceding the combustion front to fully mobilize the hydrocarbons in the formation. Also, because of the presences of reservoir irregularities such as high permeability streaks and/or fractures in the reservoir, the heatfront may approach a producing well very rapidly in comparison to another producing well, thus shortening the life of the recovery process and leaving substantial reserves in the reservoir. If the heatfront approaches a particular producing well more rapidly than the others, the well becomes hot early in the life of the project and presents considerable operating difficulties. Once the heatfront contacts such a production well, the well may also be lost. Therefore, heavy crude oil having a high viscosity makes it difficult to recover. Once heavy crude oil is recovered, it is difficult to transport anywhere, especially to a refinery.

Therefore, what is needed and what has been invented by us is a process for converting a heavy hydrocarbon crude (8°-12° API) having a high viscosity into a hydrocarbon crude having a higher °API (25°-25° API) and lower viscosity. The poduct which is much lighter exhibits properties obtained from hydrocracking or hydroprocessing as opposed to a conventional thermal operation such as cooking or visbreaking. It should be noted the conversion products, a lighter crude is lower in viscosity, sulfur and nitrogen. In one embodiment of the invention, the conversion is done in a reactor at supercritical conditions. In another embodiment of the invention, the conversion is done in a subterranean petroleum reservoir which is at supercritical conditions.

SUMMARY OF THE INVENTION

The present invention accomplishes its desired objects by broadly providing a process for converting a heavy hydrocarbon crude (8°-11° API) having a high viscosity into a lighter hydrocarbon crude gravity ranging from 25° to 35° API as well as lower viscosity, sulfur and nitrogen content. The process, which may be a batch or a continuous process, includes reacting in a reactor a majority amount of the heavy hydrocarbon crude with a minor amount of brine, at supercritical temperature and pressure for the brine, for a predetermined period of time in order to convert the heavy hydrocarbon crude into a lighter hydrocarbon crude of higher API gravity.

The present invention also accomplishes its desired objectives by broadly providing a method for upgrading a viscous heavy hydrocarbonaceous crude oil in a subterranean petroleum reservoir. The method comprises providing an injection well from the earth's surface in fluid communication with proximity to the bottom of the subterranean petroleum. An in situ combustion operation is initiated for a predetermined period of time in proximity to the bottom of the subterranean petroleum reervoir by injecting an oxidizing gas into the injection well in order to establish a combustion zone. Injection of the oxidizing gas is terminated and the injection well is shut-in for a predetermined period of time to permit the petroleum reservoir to undergo a soak period in order to decrease the viscosity of the heavy hydrocarbonaceous crude oil overlying the combustion zone. As the viscous hydrocarbonaceous crude oil decreases in viscosity, it flows downwardly into the combustion zone which is at supercritical conditions in order to upgrade the hydrocarbonaceous crude oil by cracking it into lighter products.

Therefore, it is an object of the present invention to provide a process for converting a heavy hydrocarbon crude into a light hydrocarbon crude.

It is another object of this invention to provide a process for converting a heavy hydrocarbon crude into a light hydrocarbon crude, which produce conversion products that are superior to those obtained from conventional coking or thermal operations.

It is yet another object of this invention to provide a method for cracking and upgrading a viscous heavy crude oil in situ.

It is still yet another object of this invention to provide a method for reacting connate water (i.e., brine) and the viscous heavy crude oil in situ and under supercritical conditions.

These, together with various ancillary objects and features which will become apparent to those skilled in the art as the following description proceeds, are attained by the process of this invention.

DETAILED DESCRIPTION OF THE INVENTION

Figure 1:
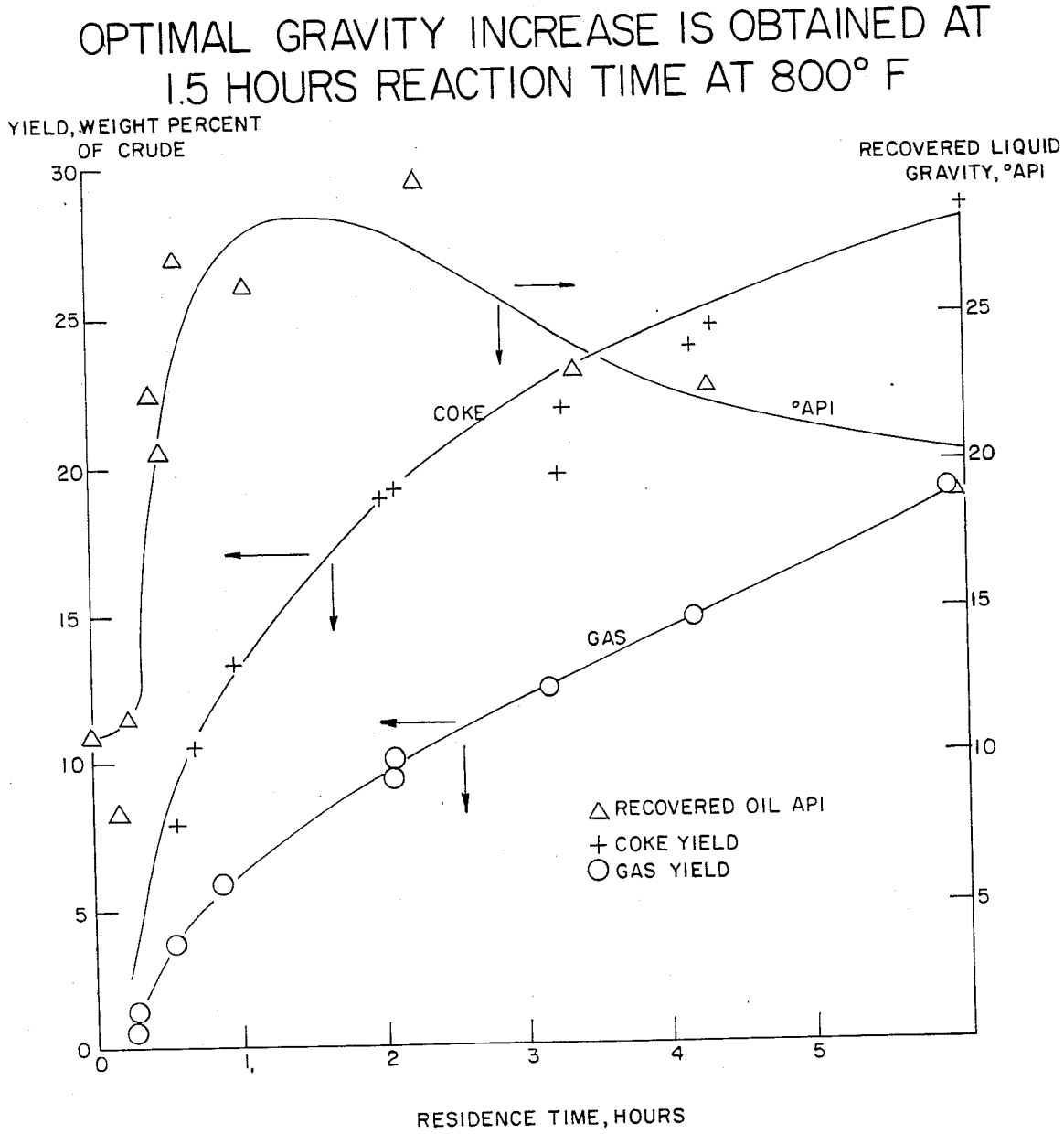
FIG. 1 is a graph reflecting the optimal gravity increase of 11° API gravity crude oil in a reactor at 800° F. and 3,900 psig.

Conventional technology for converting heavy crude oils into lighter products includes hydrocracking, or combinations of coking followed by hydroprocessing. Both of these processes utilize capital intensive equipment and require a sophisticated refinery infrastructure, including, but not limited to, hydrogen plants, methane or other suitable fuel for the production of hydrogen or a source of hydrogen.

We have discovered a batch or a continuous process that can produce at least the same products as hydrocracking, or combinations of coking and hydroprocessing, at much lower investment and operating costs. With our process, much of the refinery equipment for the production of hydrogen, or a source of hydrogen, is minimized or eliminated.

Our process is an economical process for converting a heavy hydrocarbon crude oil, having a high viscosity, into a lighter hydrocarbon product crude oil, having a lower viscosity and improved qualities. The process involves reacting in a reactor the heavy crude oil with brine at or above the supercritical temperature and pressure for brine, which depends on the concentration of sodium chloride and other salts and is generally, respectively about 705.4° F. and about 3,206 psia. Brine is any solution of sodium chloride and water (and usually contains other salts also), and has a sodium chloride concentration that varies from about 3% by wt. (ocean) to 20% by wt. or more. The residence time for the reaction of the heavy crude oil with brine in the reactor ranges from between about 0.25 hours to about 6 hours. More preferably, the temperature and pressure of the reactor are respectively from about 750° F. to about 850° F. and from about 3,300 psia to about 3,600 psia, with a residence time of from about 0.5 hours to about 2 hours. Most preferably, the reactor has a temperature and pressure of about 800° F. and about 3,500 psia, respectively, and the residence time in the reactor of the heavy crude oil in the brine is from about 1.0 to about 1.5 hours.

The amount of brine that is to react with the heavy crude should preferably be a minor amount, more preferably from about 2 wt. % to less than about 50 wt. % of the mixture comprising brine and heavy crude; and most preferably from about 20 wt. % to about 40 wt. % of the mixture comprising brine and heavy crude. We have discovered that brine is significantly better than water in converting a heavy crude to a lighter crude when the amount of brine that is to react with the heavy crude is from about 2 wt. % to less than about 50 wt. % of the mixture comprising brine and heavy crude. When the amount or quantity of brine is less than about 2 wt. %, there is essentially no conversion or production of a lighter crude from a heavy crude. When the amount or quantity of brine is above about 50 wt. %, the conversion or production of a lighter crude from a heavier crude substantially decreases. Stated alternatively, the °API of the produced light crude substantially decreases (or starts declining towards the °API of the feed heavy crude) when the quantity of brine is above 50 wt. %; and when the quantity of brine is below about 2 wt. %, the °API gravity of the product or produced crude from the heavy crude is essentially the same as the °API gravity of the heavy crude (see FIG. 2).

If a heavy crude oil and brine mixture comprising from about 2 wt. % to less than about 50 wt. % brine is placed or introduced into a reactor at 3,400–4,000 psia and 710° F.–900° F. for 0.5–6 hours such that the brine reacts with heavy crude oil, we have discovered that from 20 wt. % to 90 wt. % of the original heavy crude oil is converted into a lighter crude oil. A predetermined (unconverted) portion of the original heavy crude oil of lower API gravity is recycled back to be admixed with the original heavy hydrocarbon crude feed that is mixed with the brine. More specifically, with a heavy crude oil and brine mixture comprising 15–25 wt. % brine, and a residence time of between about 15 minutes to about 6 hours of the heavy crude in the brine in a reactor at approximately 850° F. and approximately 3,900 psig, we have found that at least about 29 wt. % of the amount of the heavy crude oil is converted into a light crude oil with gas and coke as by-products, as evidenced in the following Table I:

TABLE I

Conversion of Heavy Crude (11° API) in the Presence of Brine in a Reactor at Approximately 800° F. and Approximately 3,900 PSIG

| | | Weight Percent Product Distribution | | | | API Gravity |
|---|---|---|---|---|---|---|
| Run No. | Residence Time, Min. | Heavy Oil | Light Oil | Gas | Coke | Light Oil |
| 1 | 15 | 97.3 | 0.7 | 0.1 | 0.7 | 11.3[2] |
| 2 | 30 | 28.9 | 62.2 | 1.2 | 7.7 | 26.5[3] |
| 3 | 60 | 14.1 | 71.5 | 2.2 | 12.1 | 25.2 |

TABLE I-continued

Conversion of Heavy Crude (11° API) in the Presence of Brine in a Reactor at Approximately 800° F. and Approximately 3,900 PSIG

| | | Weight Percent Product Distribution | | | | API Gravity |
|---|---|---|---|---|---|---|
| Run No. | Residence Time, Min. | Heavy Oil | Light Oil | Gas | Coke | Light Oil |
| 4 | 120 | 5.4 | 69.0 | 4.0 | 15.4 | 18.8 |
| 5 | 240 | 9.1 | 56.9 | 12.8 | 21.1 | 21.4 |
| 6 | 360 | 9.3 | 51.0 | 17.0 | 23.0 | 17.0 |
| 7[1] | 30 | 89.4 | 2.4 | 1.0 | 2.5 | 11.2[2] |

[1]No Brine
[2]Combined Light and Heavy
[3]Combined Light and Heavy product is 21.6° API The embodiment of this invention for upgrading a viscous, heavy crude oil in a petroleum reservoir comprises extending at least one well from the earth's surface down into the bottom of a subterranean petroleum reservoir that contains the viscous heavy crude oil. After the well has been extended, an in situ combustion operation is commenced for a predetermined period of time in proximity to the bottom of the subterranean petroleum reservoir by injecting an oxidizing gas into the injection well in order to establish a combustion zone. After a combustion zone has been established in accordance with the desired pressures and temperatures, injection of the oxidizing gas is terminated, and the injection well is shut-in for a predetermined period to permit the petroleum reservoir to undergo a soak period in order to decrease the viscosity of viscous heavy crude oil imposed over or overlying the combustion zone. As the viscosity of the viscous heavy crude oil decreases, it begins to flow downwardly into the combustion zone in order to be upgraded by cracking it into lighter products. The lighter conversion products from the upgraded heavy crude oil may be produced from one or more production wells that are drilled down into the bottom of the petroleum reservoir where the lighter products accumulate and reside. The number of production wells that may be drilled may vary in accordance with the configuration desired as will be discussed in more detail hereinafter.

Through the improved process of our invention can be employed in reverse combustion, that is, wherein an oxygen-containing gas is injected into an injection well and hydrocarbons are produced from a production well with the combustion front moving from the production well to the injection well, it is more advantageously employed in a forward combustion mode, that is, wherein an oxygen-containing gas is injected into an injection well and hydrocarbons are recovered from a production well with movement of the firefront from the injection well toward the production well.

In the reverse combustion mode, the most advantageous application is in a line-drive configuration wherein a plurality of both production and injection wells are employed.

In the forward combustion mode wherein an oxygen-containing gas is injected into an injection well and hydrocarbons are produced from a production well, five-spot, nine-spot and line-drive configurations are presently preferred modes of operation.

In an inverted five-spot mode of operation, the injector well is the center well of the five-spot, and production wells comprise the other four spots of the configuration which resembles the configuration on dominoes or dice from an overhead view. In other words, the injection well is in the center of a square, from an overhead view, with four production wells lying in the corners of the square.

The inverted nine-spot mode of operation is similar to the inverted five-spot, that is, the injection well lies in the center of a square, from an overhead view, with four production wells lying in the corner of the square and four more production wells each lying in a line between two corner wells.

In a line-drive mode of operation, a plurality of injection wells are employed to inject an oxygen-containing gas into a formation causing advance of a firefront in a more or less straight line toward a plurality of production wells in a more or less straight line parallel to a line intersecting the plurality of injection wells. This mode of operation may be enhanced through the use of horizontal bore holes in the formation for both injection and production.

The improvement of the instant invention can be effected upon any conventional combustion process wherein an oxidizing gas is employed in a combustion operation.

The oxidizing gas that is utilized to initiate an in situ combustion operation in proximity to the bottom of the petroleum reservoir in order to establish a combustion zone, may be any oxidizing gas such as, including but not limited to, air, pure oxygen, a mixture of oxygen and other gases, or any other gas capable of substaining combustion of the reservoir hydrocarbons into the injection well. After combustion has been initiated by suitable means, injection of the oxidizing gas is continued in order to move the combustion front through the bottom of the petroleum reservoir. The heat generated by the combustion front creates a visbreaking zone, containing visbroken oil reduced in viscosity, in advance of the combustion front and immediately above the combustion front. The visbroken oil in advance of the combustion front and immediately above the combustion front acts as a solvent on the viscous heavy crude oil above and ahead of the visbroken zone reducing its viscosity as the combustion front progresses through the bottom of the reservoir.

The in situ combustion operation is continued using oxidizing gas fluids including oil and effluent gas that may be recovered from the petroleum reservoir for a predetermined period of time, preferably until the combustion zone has reached a temperature in the petroleum reservoir between 400° and 1,400° F. Thereafter, injection of the oxidizing gas is terminated and all wells are shut-in for a predetermined period of time to allow the petroleum reservoir to undergo a soak period. During the soak period, the petroleum reservoir undergoes further conversion. In addition, the soak period allows the heat generated by the previous in situ combustion operation to slowly dissipate upwardly into the heavy viscous reservoir and convert the reservoir oil to lighter products. The length of the soak period will vary depening on the characteristics of the heavy crude oil within the petroleum reservoir, particularly viscosity of the reservoir oil. We have discovered that the soak period should be from at least about one day to about one year.

During the soak period, the viscosity of the heavy crude oil imposed over or overlying the combustion zone decreases and the oil starts to flow downwardly (i.e., by gravity) in order for the oil to be upgraded through conversion into a ligher crude oil (i.e., an API gravity of above 20°). The conversion of heavy crude into lighter crude is comparable to a cracking operation in a refinery wherein a high molecular weight heavy gas oil is fed into catalytic crackers in order that a proportion of the feed oil may be converted into valuable gaseous products, and other light weight hydrocarbons such as components which end up in transportation fuels. As the heavy crude oil is cracked, there is also a conversion of a certain amount of it into coke. The rate of conversion into coke increases with temperature. It should be understood that the cracking process of this invention produces better hydrocarbon products than a thermal cracking, i.e., delayed coking operation in a refinery.

In a more preferred embodiment of this present invention, if the combustion zone is approximately 740° F. or above, with a pressure of at least 3,200 PSIA, connate water and/or brine may react with the heavy viscous hydrocarbon crude in order to convert it into a crude oil having a lower viscosity. By subjecting the heavy crude oil to the connate and/or brine in the petroleum reservoir at supercritical conditions, there is an intimate mixing of the reactants. Water and/or brine and crude are totally miscible and provide the necessary residence time not obtainable under subcritical conditions. We have discovered that with respect to this embodiment of the invention, some of the connate water and/or brine is consumed. As has been previously indicated, brine is preferred over water because brine produces a lower viscosity and higher °API product. The presence of hydrogen sulfide with carbon monoxide and high ratio of saturates to unsaturates in the product suggests a water hydrocarbon shift reaction. Coke formation and unsaturate production are lower than predicted from a thermal cracking at similar conditions of temperature and residence time in a conventional reactor system. We have also discovered that the products produced by reacting the connate water and/or brine with the heavy hydrocarbon crude at supercritical conditions, the convention products appear to approximate typical hydrocracking conditions as opposed to conventional thermal operation. The conversion products are far superior to those obtained from conventional thermal operation.

After the soak period has been terminated, after a predetermined amount of time which would be the time necessary to allow the majority of the heavy crude oil to flow downwardly in order to be converted, the wells are re-opened in order to produce upgraded crude oil from the bottom of the petroleum reservoir. It should be understood that the upgraded crude oil in the bottom of the reservoir may be produced from any production well by any conventional means utilized in that secondary or tertiary recovery means.

For the purpose of simplicity in describing this invention, reference has been made only to a limited number of injection wells and limited number of production wells. However, it will be recognized that a practical application of this invention, a plurality of injection wells along the bototm of the petroleum reservoir and the plurality of production wells drilled to the bottom of the petroleum reservoir may be used and in most cases will be utilized. In a preferred embodiment of the invention, it is preferred to use the five-spot pattern with the corner wells initially as injection wells and ignited and burned in a forward combustion mode to provide an adequate heat zone around them. When the heat zone has been established, the injection wells would then be converted to producer wells and the center well placed on forward combustion. The heavy crude mobilized from combustion through the center well would cross the hot zone and would be converted into light products in transit to the producer wells (i.e., the former injection wells).

Our invention will be illustrated by the following set forth examples which are given by way of illustration and not by any limitation. All parameters such as concentrations, mixing proportions, temperatures, pressures, etc., submitted in the examples are not to be construed to unduly limit the scope of our process for converting a heavy hydrocarbon crude having a high viscosity into a hydrocarbon crude having a lower viscosity.

EXAMPLE I

Microautoclaves that are used for testing measure 1" in diameter and 6" in length with an internal volume of 43 $cm^3$. In a test, a microautoclave is loaded with a heavy crude and brine, giving a crude, brine mixture. Three ¼" diameter stainless steel balls are used for mixing. The vessel is sealed to contain pressures in excess of 5,000 psig. The microautoclave is then immersed in a fluidized bed of sand which has been preheated to the reaction temperature. By using an eccentric mechanical configuration at 600 RPM, vigorous agitation with the stainless steel balls is established. The internal temperature of the crude is raised to that of the sand in about 1 minute. During the run the internal temperature and pressure of the microautoclave are monitored. After a specified period of heating, the microautoclave is rapidly quenched in cold water. Using this method, the reaction kinetics of oil conversion can be determined as a function of many variables, including residence time, pressure, mineral activity, and water/brine concentrations.

In order that a continuous commercial process may be more accurately simulated, a steady-state, pressure-regulated experiment may be conducted in a 1-liter stirrer autoclave which has a 500 ml liquid holding capacity. The unit is computer controlled for unattended operation for run durations of several days requiring only one shift to check unit operations, charge feed tanks, and drain products. Heavy crude blended with brine may be pumped into the autoclave at rates that vary (e.g., from 150 gm/hr to 300 gm/hr) for liquid residence times at steady-state conditions. Gas and liquid products are recovered from the autoclave for material balance determinations.

An 11° API heavy crude oil was reacted with approximately 20 wt. % brine in a reactor having a temperature of 800° F. and a pressure of about 3,500 psia. The recovered oil reached a maximum API gravity (i.e., approximately 30° API) after a residence time of from about 1.0 to about 1.5 hours (see FIG. 1). Coke and gas were produced as by-products. With a residence time of from about 1.0 hours to about 1.5 hours, approximately from about 25 wt. % to about 28 wt. % of light crude (i.e., 25°-28° API) from the original amount of 11° API heavy crude oil was produced. Within this 1.0-1.5 hours residence time, only about 12-14 wt. % coke and 5-7 wt. % gas was produced.

The reason for subjecting brine and heavy crude at or above supercritical conditions is to provide the intimate mixing of the reactants and the desired conditions for converting heavy crude into a lighter crude. Brine and crude are totally miscible and provide the necessary residence time not obtainable under subcritical conditions in a conventional reactor system. An unexpected result found was the presence of $H_2S$ with CO and a high ratio of saturates to unsaturates in the product, and this indicated a brine hydrocarbon shift reaction, all as indicated in the following Table II:

TABLE II

Gas Analysis
The Presence of Hydrogen Sulfide, Carbon Monoxide, and High Ratio of Saturates to Unsaturates in the Light Ends Indicates Brine Reacted with Crude Oil

| | |
|---|---|
| Hydrogen | Trace |
| Methane | 33.4 |
| Ethane | 13.1 |
| Ethylene | 1.5 |
| Propane | 10.9 |
| Propylene | 1.9 |
| Butanes | 19.9 |
| Butenes | 4.2 |
| Hydrogen Sulfide | 4.9 |
| Carbon Monoxide | 5.6 |
| Carbon Dioxide | 4.6 |
| | 100.0 |

Other unexpected results discovered included the following: brine was consumed; coke formation and unsaturated production are lower than predicted from thermal cracking; the conversion products appear to approximate typical hydrocracking conditions as opposed to conventional thermal cracking or coking; and the useful conversion product yields as measured by gas plus liquids produced are far greater than those obtained from conventional coking.

EXAMPLE II

Example II summarizes the effects of reactor temperature on the saturate to unsaturate gas ratio and compares the results with coking. The ratio of saturates to unsaturates in light ends is significantly greater than obtained from delayed coking. The sensitivity to temperature shows the ratio at 750° F. and 800° F. under supercritical conditions versus delayed coking. Note the results; i.e., saturates/unsaturates are far greater under supercritical conditions. For example, the saturated to unsaturated $C_4$ yields are greater than 100, versus 1.5 for coking. The same can be said for $C_3$'s and $C_2$'s.

| | Supercritical | | |
|---|---|---|---|
| | Run K14 | Run IB5 | Coking[1] |
| Temperature | 750° F. | 800° F. | |
| Pressure | >3200 psig | >3200 psig | |
| Residence time | 240 mins. | 240 mins. | |
| Saturate to unsaturate ratio: | | | |
| $C_2$'s | 110.0 | 21.1 | 10.8 |
| $C_3$'s | 16.8 | 6.4 | 2.7 |
| $C_4$'s | >100.0 | >100.0 | 1.5 |

[1]James H. Gary, Glenn E. Handwerk, Petroleum Refining, Technology and Economics, p. 63.

EXAMPLE III

Example III shows the criticality and effect of brine reaction with crude under supercritical conditions. Table I, shown previously, compares the effects of conversion.

| | Run 2 | Run 7 (see Table I) |
|---|---|---|
| Feed | Crude + Brine | Crude |
| Residence time, min. | 30 | 30 |
| Gravity Crude, °API | 11.0 | 11.0 |
| Products | | |
| Gas yield, wt. % | 1.2 | 1.0 |
| Coke yield, wt. % | 2.5 | 7.7 |
| Hydrocarbon liquid product gravity, °API | 21.6 | 11.1 |

The results indicate that without brine, the product is essentially the same as feed; i.e., gravity feed is 11.0; the gravity of liquid product is 11.1 °API. With brine, the conversion product gravity is 21.6° API.

EXAMPLE IV

A comparison of the results under supercritical versus subcritical conditions indicates little or no conversion products at the subcritical condition.

| | Run 1B9 | Run 5S |
|---|---|---|
| Condition | Supercritical | Subcritical |
| Pressure | >3200 psig | <3200 psig |
| Temperature, °F. | 800 | 700 |
| Residence time, min. | 30 | 60 |
| Gas yield, wt. % | 2.9 | 0 |
| °API light oil product | 39.1 | 11.0 |
| Coke yield, wt. % | 12.1 | 0 |

There was essentially no conversion to coke and gas at the subcritical temperature of 700° F. and the liquid product was essentially the same as the feed.

EXAMPLE V

A comparison of our process for converting heavy crudes to lighter products in the presence of brine at supercritical conditions versus the use of coking is shown below. Of significance is the production of undesirable coke which is significantly lower; i.e., 10.0% versus 30.4% for coking. The gravity of the liquids produced from coking is 30.9° API versus 23.5° API for the supercritical process. The coking operation produces a product which is highly unsaturated and, in commercial application, must be treated further commonly using hydroprocessing.

A Comparison of Delayed Coking with "Supercritical Conversion of Heavy Crude with Brine"

| | Delayed Coking[1] | Supercritical |
|---|---|---|
| Operating Conditions | | |
| Temperature, °F. feed | 925 | 750–850 |
| Pressure, psig | 25–30 | 3400–3900 |
| | | 30 mins. (residence time) |
| Properties of Feed | | |
| °API | 10.7 | 11.0 |
| Conradson carbon, wt. % | 19 | 19.0 |
| Products, wt. % | | |
| Coke | 30.4 | 10.0 |
| Gas, $C_4$'s and lighter | 10.5 | 2.0 |
| Liquid | 59.1 | 88.0 |
| Total | 100.0 | 100.0 |
| Gravity liquid hydrocarbon, °API | 30.9 | 23.5* |

*Gravity of combined heavy oil and light oil

[1]James H. Gary, Glenn E. Handwerk, Petroleum Refining, Technology and Economics, pp. 58–63.

EXAMPLE VI

HPLC and GC results of reactor residue products; i.e., conversion products for supercritical processing of heavy crude plus brine, indicate a significant increase in the saturated products with a concomitant reduction in the asphaHene content. The results show that the product quality; i.e., conversion of asphaltenes to more desirable aromatics and saturated products is significant.

| | Wt. % of Feed Analysis of $C_{15}$ Fraction | | | |
|---|---|---|---|---|
| | Saturates | Aromatics | Asphaltenes | NSO(1) |
| Crude feed | 29.5 | 31.7 | 25.4 | 13.4 |
| Reactor residue product | 35.5 | 33.9 | 13.2 | 17.4 |

(1)Fraction containing heteroatoms; nitrogen, sulfur and oxygen.

A comparison of the hydrogen to carbon ratio of the feedstock and the liquid produced indicates no apparent change substantiating the quality.

| | Feedstock Crude 11° API | Liquid Product |
|---|---|---|
| Run # | | IB10 |
| Reactor Temp. °F. | | 800 |
| Pressure, psig | | 3900 |
| Residence Time (mins.) | | 30 |
| Hydrogen/Carbon | 0.12 | 0.12 |

Liquids produced from coking operations, such as delayed or fluid coking (see G. Bridge, D. Gould, F. Berkman, *OIL & GAS JOURNAL*, Jan. 19, 1981, pg. 85) have a lower hydrogen/carbon ratio than the feed. For example, a comparison of the hydrogen/carbon ratio (H/C) for a Arabian heavy crude with an average boiling point of 1000° F. indicates the H/C ratio of approximately 0.14 whereas the liquid product from fluid coking shows an H/C equal to 0.11. The H/C ratio for a lighter fraction such as the 650° F. indicates the H/C to be 0.13. The native crude would have a corresponding H/C of approximately 0.15. As indicated previously our process shows no change of H/C ratio in the crude and product, indicating a superior product.

EXAMPLE VII

In order to obtain the benefits of in situ upgrading in bitumen or heavy crude reservoirs, it is necessary to devise a method of raising the reservoir temperature for the time required to allow the desired cracking reactions to take place. The minimum temperature was in the 500° to 700° F. range with corresponding residence times of a few hours to several weeks. One method which was implemented to provide the required reservoir conditions was to first perform a fireflood operation in the lower part of a thick reservoir. This process was followed by a soaking period in which the heavy oil above and adjacent to the burned zone would flow into this region and undergo the desired reactions. Finally, the upgrading oil would be produced by pumping or by other means.

Simplified computer models were used to examine the heat transfer and fluid flow processes in the operation. The idealized reservoir was rectangular block shaped and was modelled to estimate the quantity of oil which could be treated and recovered from the known reservoir area. The lower part of the reservoir volume represents the portion affected by a forward combustion operation, while the upper part is the volume to be upgraded and recovered. The simulation of the process was performed in two steps. First, a fireflood model was used to determine an initial temperature distribution within the reservoir. Then the movement of this heat into the surrounding reservoir by conduction and the flow of the heavy oil into the hot zone were determined.

The combustion operation was modelled using a modified form of a computer program. This program solves the differential equations describing the forward combustion process in the two horizontal dimensions. Only the flow of gas was considered in this model. The equations define the flow of air and combustion gases in the reservoir, the production of heat at the combustion front, and the transfer of heat thrugh the reservoir by conduction and convection.

The following assumptions were made for the mass flow calculations: (1) flow is laminar; (2) there are no capillary effects; (3) thermodynamic equilibrium existed between all phases; and (4) mass transfer between phases due to vaporization-condensation is negligible.

The formation contained oil, gas and water and a porosity of $\phi$. A mass balance was performed on each of these phases for stationary volume elements through which they flow in the X and Y directions. Only gas flow was simulated in the calculations because the primary interest was the extent of the fireflood and not oil recovery from this zone.

Estimations of heat transfer in the reservoir were as follows: (1) condensation and vaporization effects were negligible; (2) heat capacity and thermal conductivity were constant; (3) uniform temperatures and pressures were initially present throughout the reservoir; (4) the reservoir was isolated (i.e., there were no heat losses due to moving water or brine contact with the formation); (5) fuel content was uniform and was entirely consumed inside the fireflood zone; (6) heat transfer by radiation was negligible.

The heat balance for each element in the reservoir is:

| | | | | | | |
|---|---|---|---|---|---|---|
| Net heat accumulation | = | Net transferred by conduction and convection | + | rate generated by combustion | − | rate losses adjacent elements |

The physical reservoir was of square geometry with one producing well and one injection well located at diagonally opposite corners of the reservoir. Pressure and air injection rates were specified at the wells. The program modeled combustion in a vertical as well as horizontal direction, and included the effects of gravity and allowed for different permeabilities in different directions. The movement of the combustion front was a function of time after ignition.

The movement of heat into the reservoir was by conduction only. The combustion process was stopped after ten days. At this time, the combustion front was about 30 feet from the air injection point and the maximum temperature inside the fireflood zone was 1,160° F. After almost one year, the maximum temperature dropped to 530° F. and temperatures of 200° F. extended about 565 feet into the reservoir.

A temperature profile was used to estimate the quantity of oil flowing by gravity into the hot zone. The downward velocity of the oil (gravity driven) follows Darcey's Law:

$$V = \frac{K}{\mu} \rho \frac{g}{g_c}$$

where:

K is the effective permeability of the oil in a vertical direction;

$\mu$ is the oil viscosity;

$\rho$ is the oil density.

The velocity of a heavy oil with a viscosity of 15,000 cp at 100° F. was very low and did not increase significantly until the temperature reached about 200° F. Thus, until the heavy oil was heated by heat transfer from the hot zone, it will not begin to flow.

The movement of oil into the hot region was a function of time and initial position in the reservoir. The position of the oil at the end of a small time increment was calculated using the average velocity during the interval given by Darcy's Law. After the temperature reached about 200° F., the oil at a given position began to flow, accelerated as it flowed into hotter rock, and reached the bottom of the reservoir fairly quickly. In this example, approximately 25 feet of the reservoir above the combustion front was affected within one year.

The rate of production started at 45 bbls/day but decreased to 6 bbls/day after approximately one year. The total production in this period for the assumed 30-foot by 150-foot reservoir area was 5,500 bbls. Thus, at least 40% of the calculated oil in place was recovered.

EXAMPLE VIII

Pilot plant tests were conducted on 11° API gravity heavy crude feed having brine ranging from about 0 wt. % to about 60 wt. % brine with the reactor having 710°–900° temperatures and 3,300–3,600 psi measures, and the residence times ranging from about 0.25–2.5 hours. The solid line graph in FIG. 2 reflects an estimated average of °API gravity of produced crude vs. brine wt. % (in initial heavy crude/brine mixture) for the 11° API gravity heavy crude feed. As can be readily seen, below about 2 wt. % brine there is essentially no change in the beginning °API gravity of heavy crude feed and the final °API gravity of the finally produced lighter crude. Also, when more than about 50 wt. % brine is employed in the initial heavy crude/brine feed, the °API gravity of the finally produced lighter crude dramatically, precipitously decreases. Thus, optimum conversion of heavy crude into lighter crude is accomplished by employing from about 2 wt. % to less than about 50 wt. % brine.

EXAMPLE IX

Figure 2:
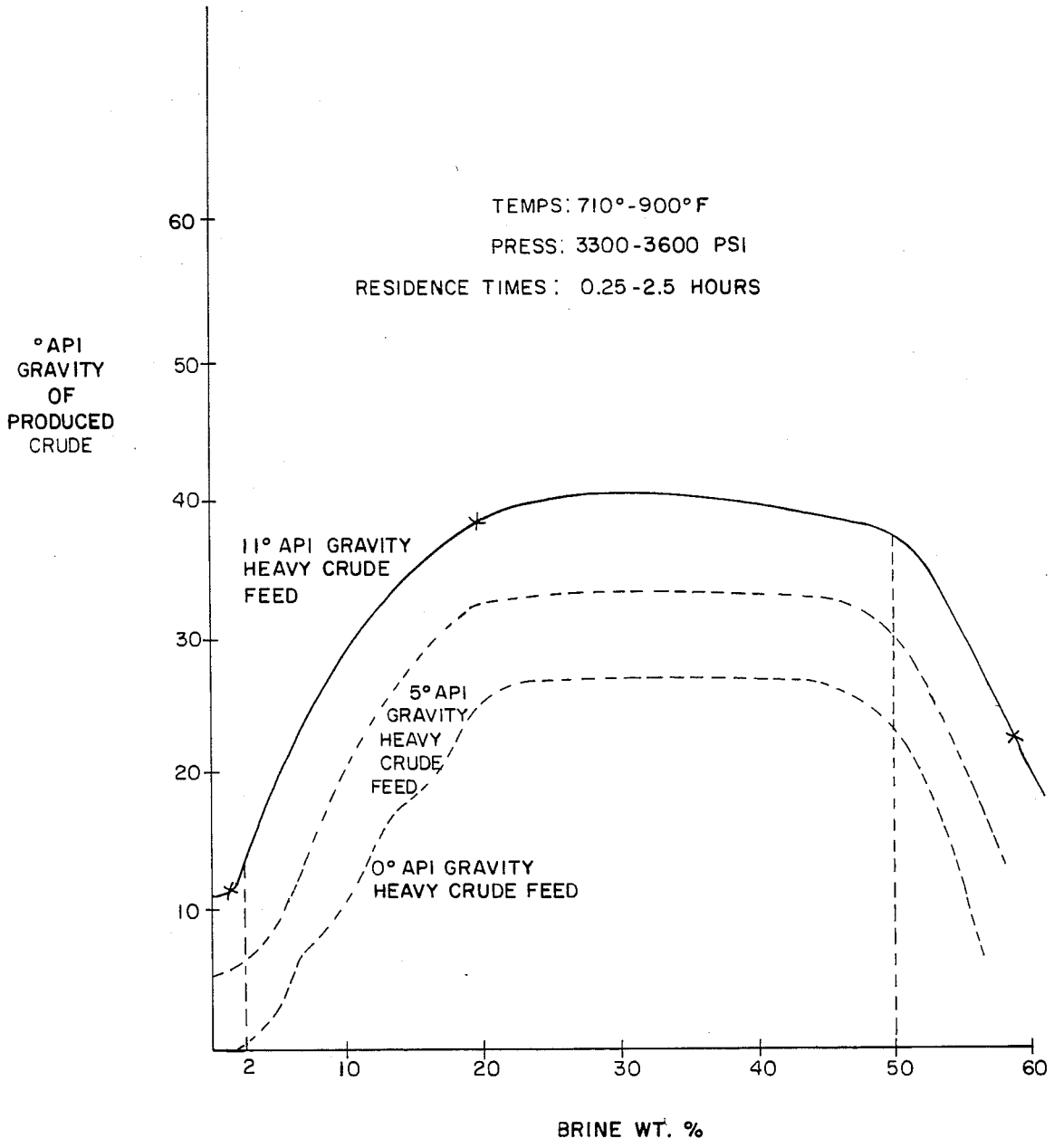
FIG. 2 is an estimated graph of °API gravity of produced crude vs. brine wt. % (in heavy crude/brine mixture) for 11° API gravity heavy crude feed at temperatures of 710°-900° F., pressures of 3,300-3,600 psi, residence times of 0.25-2.5 hours, with 5° API gravity and 0° API gravity heavy crude feed represented as dotted lines.

Repeat Example VIII for 5° API gravity and 0° API gravity heavy crude feed and find similar estimated results as illustrated by the dotted line graphs in FIG. 2.

EXAMPLE X

Example VIII is repeated for 11° API gravity heavy crude feed having water (instead of brine) ranging from about 0 wt. % water to about 60 wt. % water under similar operating conditions in the reactor (i.e., temperatures, measures, and residence times). The dotted line graph in FIG. 3 reflects an estimated average of °API gravity of produced crude vs. water wt. % (in initial heavy crude/water mixture) for the 11° API gravity heavy crude feed. As is readily seen, below about 2 wt. % water, there is essentially no change in the beginning °API gravity of heavy crude feed and the final °API gravity of the finally produced lighter crude. Also, when more than about 50 wt. % brine is employed in the initial heavy crude/water feed, the °API gravity of the finally produced lighter crude precipitously decreases. Thus, optimum conversion of heavy crude into lighter crude is estimated to be accomplished by employing from about 2 wt. % to less than about 50 wt. % water. When results of using brine versus water are compared (i.e., FIG. 2 vs. FIG. 3), brine is much superior to water.

EXAMPLE XI

Figure 3:
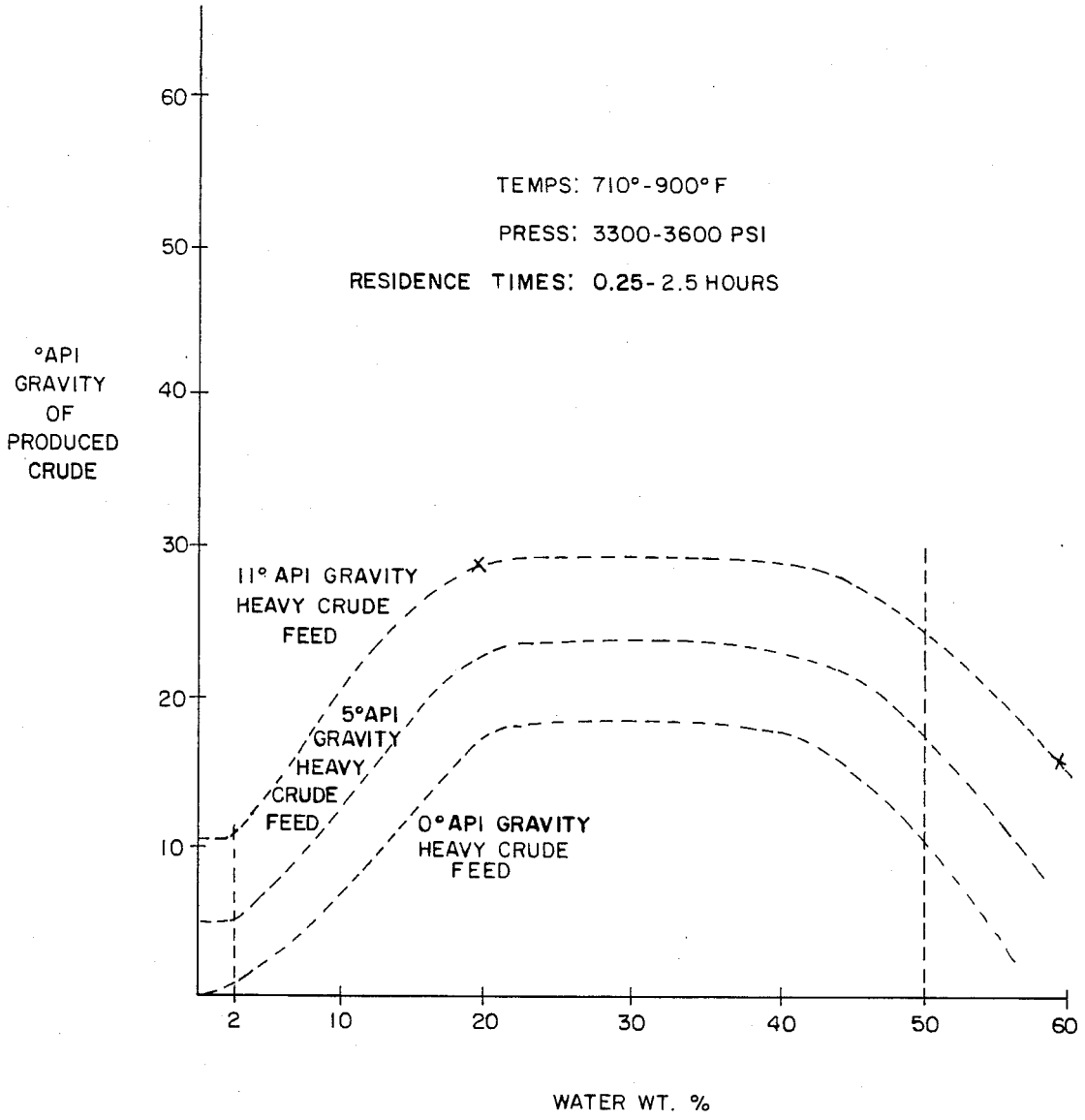
FIG. 3 is an estimated dotted line graph of °API gravity of produced crude vs. water wt. % (in heavy crude/water mixture) for 11° API gravity heavy crude feed at temperatures of 710°-900° F., pressures of 3,300-3,600 psi, residence times of 0.25-2.5 hours, with 5° API gravity and 0° API gravity heavy crude feed also represented as dotted lines.

Repeat Example X for 5° API gravity and 0° API gravity heavy crude feed and find similar estimated results as illustrated by the dotted line graphs in FIG. 3. The use of brine (instead of water) in a quantity or an amount ranging from about 2 wt. % to less than about 50 wt. % produces a significantly higher °API gravity lighter crude (having a lower viscosity) than by using water, as illustrated in FIGS. 2 and 3.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

We claim:

1. A continuous process for converting a hydrocarbon fuel crude oil with an API gravity into a hydrocarbon crude oil product having a higher API gravity compared to that of the feed crude oil comprising (a) introducing into a reactor a mixture containing a first hydrocarbon crude with a first API gravity and from about 2 wt. % brine to less than about 50 wt. % brine; and (b) reacting the first hydrocarbon crude with the brine in the reactor at at least the supercritical temperature and pressure for the brine in order to convert the first hydrocarbon crude into a second hydrocarbon crude having a second API gravity that is higher than the first API gravity of the first hydrocarbon crude.

2. The process of claim 1 wherein from about 20 wt. % to about 90 wt. % of the first hydrocarbon crude is converted into the second hydrocarbon crude.

3. The process of claim 1 wherein said first hydrocarbon crude has a residence time in the brine of from about 0.25 hours to about 6 hours.

4. The process of claim 3 wherein the temperature is between about 750° F. and 850° F.

5. The process of claim 4 wherein the pressure is between about 3,300 psia and 3,600 psia.

6. The process of claim 3 additionally comprising recovering a gas and coke as a by-product.

7. The process of claim 1 wherein said mixture of first hydrocarbon crude and brine comprises from about 20 wt. % to about 50 wt. % brine.

8. The process of claim 7 wherein the first hydrocarbon crude oil has a residence time in the reactor of from about 0.25 hours to about 6 hours, and the temperature is from about 720° F. to about 900° F., and the pressure is from about 3,300 psia to about 3,600 psia, and from about 20 wt. % to about 90 wt. % of the first hydrocarbon crude is converted into the second hydrocarbon crude.

9. The process of claim 1 wherein from about 20 wt. % to about 90 wt. % of the first hydrocarbon crude is converted into the second hydrocarbon crude; and recycling a portion of the first hydrocarbon crude to be admixed with the mixture of step (a).

* * * * *